United States Patent [19]

Haase

[11] 4,230,282

[45] Oct. 28, 1980

[54] COMMINUTING PLANT

[75] Inventor: Egon Haase, Balzers, Liechtenstein

[73] Assignee: MOCO Maschinen- und Apparatebau GmbH & Co. KG, Mannheim, Fed. Rep. of Germany

[21] Appl. No.: 919,947

[22] Filed: Jun. 28, 1978

[30] Foreign Application Priority Data

Jul. 4, 1977 [DE] Fed. Rep. of Germany ..... 2730188

[51] Int. Cl.[3] ..... B02C 18/06

[52] U.S. Cl. ..... 241/159; 241/236

[58] Field of Search ..... 241/152 A, 159, 236, 241/79.1

[56] References Cited

U.S. PATENT DOCUMENTS

| | | | |
|---|---|---|---|
| 1,388,551 | 8/1921 | Cooper | 241/159 X |
| 1,512,929 | 10/1924 | Himoff | 241/236 X |
| 1,561,093 | 11/1925 | McCorgar | 241/152 A X |
| 1,706,935 | 3/1929 | Milne | 241/236 X |
| 1,806,139 | 5/1931 | Ackerman | 241/159 |
| 2,644,643 | 7/1953 | Frisch et al. | 241/159 X |
| 3,921,920 | 11/1975 | Brocard | 241/159 |
| 3,960,335 | 6/1976 | Haberle | 241/152 A X |

FOREIGN PATENT DOCUMENTS

| | | | |
|---|---|---|---|
| 691460 | 4/1940 | Fed. Rep. of Germany | 241/159 |
| 1074998 | 2/1960 | Fed. Rep. of Germany | 241/236 |
| 412934 | 5/1974 | U.S.S.R. | 241/236 |

*Primary Examiner*—Mark Rosenbaum

*Attorney, Agent, or Firm*—Friedman, Goodman & Teitelbaum

[57] ABSTRACT

A comminuting plant is equipped with a comminuting machine for the coarse comminution of bulky material, and a granulating machine for the fine granulation of the precomminuting material from the comminuting machine. The comminuting machine includes at least two parallel shafts having several rotary bodies arranged on each shaft to provide cutting disks. Between the cutting disks in each case, there are arranged separate spacers. The spacers are smaller in diameter than the cutting disks, and turn with the shafts in such a way that the cutting disks of adjacent shafts cooperate, as the cutting disks touch each other in rotation, at least intermittently in the zone of their facing cutting edges. The circumferential surfaces of the spacers provide interspaces for the passage of the comminution material. The granulating machine includes at least two shafts disposed in one plane and at least two further shafts arranged in another plane, preferably parallel to the first plane, several rotary bodies being arranged on each shaft to provide granulating disks, each disk having a toothing. Between the granulating disks in each case, there are arranged separate spacers. The disk spacers are smaller in diameter than the disks, and are turnable with their respective shafts in such a way that the granulating disks of one shaft are engaged between the granulating disks of at least one shaft lying in the same plane and of at least one of the shaft lying in the other plane at least to a depth greater than the depth of the toothing in the disks.

9 Claims, 10 Drawing Figures

Fig. 3a
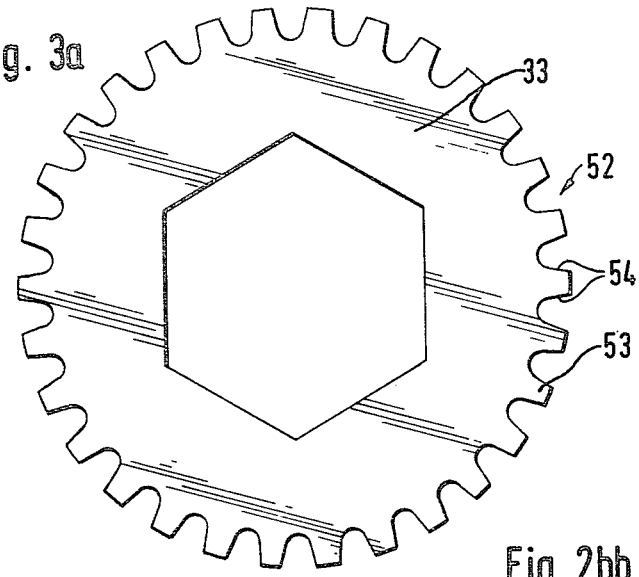
Fig. 2bb
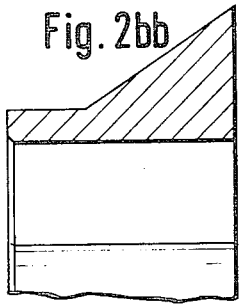
Fig. 2ba
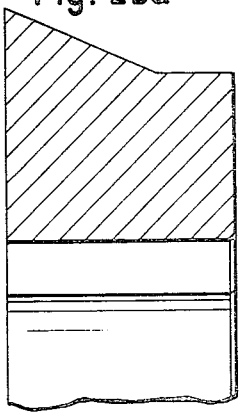
Fig. 2bd
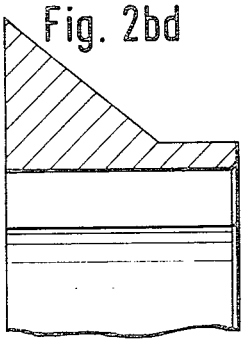
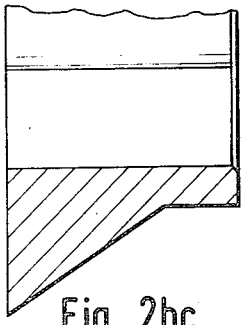
Fig. 2bc

COMMINUTING PLANT

The invention relates to a comminuting plant, in particular for the comminution of waste substances, with rotary bodies turning in opposite directions, between which the material to be comminuted passes.

In such comminuting plants the rotary bodies turn at about 20 to 100 revolutions per minute (slow-speed machines). The comminution of the material, therefore is achieved not, as in the case of so-called high-speed machines, by reason of the speed of the comminuting tools, but by reason of the special design of the comminuting system. As to the waste materials to be comminuted, these include, in particular, paper, cardboard, plastics, foam substances, vehicle tires, wood, sheet metal packings, textiles, etc.

The comminution of such waste materials takes place for purposes of recycling, volume reduction and/or to make it unrecognizable.

For the comminution of materials of the most diverse starting dimensions to a desired granulate size, hitherto there were required comminution plants expensive in construction and thereby costly to build, and, moreover, highly susceptible to wear, and in some cases having several machine units of different type. The susceptibility of wear reduces the economy in operating such comminution plants quite considerably, so that, in particular, a comminution for the purpose of recycling the waste materials was frequently of no interest because of the costs.

The problem of the present invention is to provide a new comminuting plant of the type in question, in which with low constructive expenditure and, in particular, comparatively little susceptibility to wear, both relatively bulky starting materials and also already precomminuted material can be comminuted in maximally only two stages to a granulate of the desired grain size. The aim of the invention, therefore, is in the first place to make do with as few as possible, possibly just one comminution stage and to make these comminution stages themselves especially free of wear and, therefore, long-lived.

This problem is solved by a comminuting machine with at least two parallel shafts on each of which there are arranged several rotary bodies constructed as cutting discs provided on the circumference with cutting edges and between the cutting disks in each case there are arranged separate spacers, smaller in diameter, changeable, but so as to turn with the shafts, in such a way that the cutting disks of adjacent shafts cooperate, as the cutting disks touch each other in rotation in pairs at least intermittently in the zone of their facing cutting edges, while the circumferential surfaces of the appertaining spacers allocated to one another bound in each case interspaces for the passage of the comminution material.

With the aid of such a comminution plant having a special comminuting machine, relatively bulky waste materials can be rapidly and efficiently comminuted, since the cutting disks interacting on one side in the cutting edge zone cut up, crush or tear the fed-in material. Through the fact that the cutting disks interact in each case only on one side and the spacers have a greater axial length than the thickness of the cutting disks, the individual cutting disk-spacer sets can be suitably readjusted on wearing down of the facing cutting disk sides on the respective shafts. On excessive wearing down of the one cutting edge side of a cutting disk it is directly possible to turn this around, so that when the other cutting edge side cooperates with the corresponding cutting edge side of the cutting disk of the adjacent shaft. Through the special design of the cutting disks and spacers, which are emplaceable on the respective shafts to turn with them and removable from them, it is possible, therefore, to more than double the life of such a comminution plant. The axial length of the spacers between the respective cutting disks is made such that correspondingly large interspaces form between the cutting disk pairs on the one hand and the peripheral surfaces of the spacers on the other hand, so that the comminuted material can pass through. In this manner an improved throughput performance with dependable comminution is possible. The spacers can be selected in, particular, with respect to their axial length in adaptation to the starting material and the degree of comminution desired, whereby the comminuting plant can be adapted in a simple manner to the various waste materials.

It has proved in practice to be especially effective to have the cutting disks provided with arcuate cutting edges, possibly presenting notches. In this case, therefore, the cutting disks allocated to one another in pairs do not touch in each turning position in the zone of their cutting edges but only when the cutting edge zones correspondingly of circular-arc or section form are in register and lie adjacent to one another. Through these arcuate cutting edges there can be achieved—besides in improved material intake—especially the result that materials do not wind around the spacers but are released again and again.

There it has proved especially expedient to provide on one and the same cutting disk arcuate cutting edges of differing peripheral length, since in this manner there takes place an irregular interaction of the cutting disks allocated to one another in pairs in the zone of their cutting edges.

The peripheral lengths of the arcuate cutting edges correspond their expediently to a central angle between 20° and 80°, preferably 40° to 70°.

In order further to promote the intentionally irregular interaction of the cutting disks in the respective cutting edge zone, the cutting disks can be disposed angularly offset to one another on a shaft.

There it is further especially advantageous to drive the adjacent shafts asynchronously, either directly or indirectly, in order to ensure a uniform wear on the cutting edges of the cutting disks.

The spacers are preferably adapted in their cross section, at least on their end facing the allocating cutting disk, to the circumferential form of the associated cutting disk. In this manner, namely, the respective cutting disks can be effectively backed on their side lying opposite the side in use at that time of the cutting edge, and, namely, by making the cutting disks themselves project radially only slightly beyond the spacers in their cutting edge zones, so that for the cutting disks there can be used material hardened throughout, preferably hardened steel, which is not possible in the absence of support because of the high axial stress on the cutting disks, especially in the radially outer cutting edge zones.

In order to keep the desired interspaces for the passage of the comminuted material as large as possible with a given cutter disk diameter, the spacers may be conical.

For the same reason the spacers on adjacent shafts are preferably arranged so that they taper in the opposite axial direction.

The spacers may further be externally polygonal, for example hexagonal, in cross section, preferably according to the number of arcuate cutting edges of the cutting disks, which ensures the conveyance of the comminuted material and the keeping clear of the interspaces.

The material intake in the comminuting plant of the invention can be improved by having the axes of each pair of adjacent shafts lie in a plane that is inclined by an angle of expediently not more than 30° to the plane perpendicular to the material feed direction. If, therefore, for example, the material is introduced into the comminuting plant from above, the axes of every two adjacent shafts lie in a plane that is inclined to the horizontal plane by the determined angle.

While the comminuting plant according to the invention equipped with the comminuting machine explained above is intended for relative bulky waste materials, there frequently arises the problem of bring, for example, already precomminuted materials to a still smaller grain size. This is possible if the comminuting plant of the invention is equipped with a granulating machine with at least two shafts disposed in one plane and at least two shafts arranged in another plane, preferably parallel to the first plane, on which in each case several rotary bodies constructed as granulating disks, provided with a toothing and between the granulating disks in each case there are arranged separate spacers, smaller in diameter, but turnable with the shaft in such a way that the granulating disks of one shaft in each case engage between the granulating disks of at least one shaft lying in the same plane and of at least one of the shafts lying in the other plane at least to a depth greater than the depth of the toothing.

Such a granulating machine, therefore, has several planes arranged successively in material conveyance direction, preferably one below the other, in which are arranged at least two shafts cooperating with their granulating disks. The two planes are now spaced from one another at such a distance that not only the granulating disks of the shafts arranged in the one plane cooperate, but also, in pairs, the shafts equipped with granulating disks of adjacent planes. Thus, for example, to two shafts arranged in an upper plane there may be allocated two further shafts arranged in a lower plane; thus in practice there is formed a shaft set with shaft axes lying in the corner points of a square, the granulating disks of one shaft engaging in each case between the granulating disks of the shafts arranged in the two adjacent corners. It has proved that with such a dense arrangement of shaft pairs each disposed in a plane there can be achieved a substantially more favorable degree of granulation than in the case of two pairs of shafts arranged at an arbitrary distance one behind the other, since the comminution of the material takes place not only in the plane lying in the main conveyance direction of the material, but also in a plane transverse thereto. The granulating disks do not necessarily have to be equipped with cutting edges, since the peripheral toothing, by reason of the engagement of the respective granulating disks between each two granulating disks of the adjacent shaft, provides for the requisite comminution. A wearing down of the tooth edges is hardly of any significance in this arrangement, since especially if the spacer disks are only slightly thicker than the granulating disks, the granulating disks also run closely into one another on both sides in a zone in which there is no longer any toothing present.

Since the toothing presents teeth with substantially radial flanks, in the granulating of old tire material there takes place a separation of pieces of metal from rubber and cord, so that the metal constituents can simply be separated from the granulate later, for example by means of a magnetic roller, without too much rubber material being lost to recycling.

If the teeth are radially symmetrical, moreover, the granulating disks can be directly turned around after wearing down of the tooth edges on one side, so that then the previous trailing edge not yet worn down of the respective teeth is available for the granulating. Hereby likewise the time of use of the granulating disks is doubled, as in the case of the cutting disks of the comminuting machine.

A comminuting plane that proceeds from a relatively bulky starting material and comminutes this to a very fine-grained granulate can be achieved with a combination of the previously explained comminuting machine with a granulating machine engaged on outlet end.

The comminution there is subdivided, therefore, into two comminution stages, in the first stage there being used a comminuting system that is suited especially for bulky materials, while in the second stage there is used a granulating system which operates optimally in cutting materials already precomminuted. Both stages are by themselves constructed especially resistant to wear.

In the combination of comminuting machine and granulating machine, the comminuting machine preferably presents at the material outlet a screen, which can be adapted to the grain size to be processed preferably by the granulating machine.

In order to ensure a uniform charging of the granulating machine, there can be provided between comminuting machine and granulating machine a conveying device, in particular a vibrator.

To achieve a compact comminuting installation, comminuting machine and granulating machine can be mounted on a common machine frame with the associated accessory, operating and control arrangements.

Further features, advantages and possibilities of use of the present invention are yielded from the following description of an example of execution with the aid of the appended drawing. There, all the features described and/or represented by themselves or in any reasonable combination form the object of the present invention.

Figure 2:
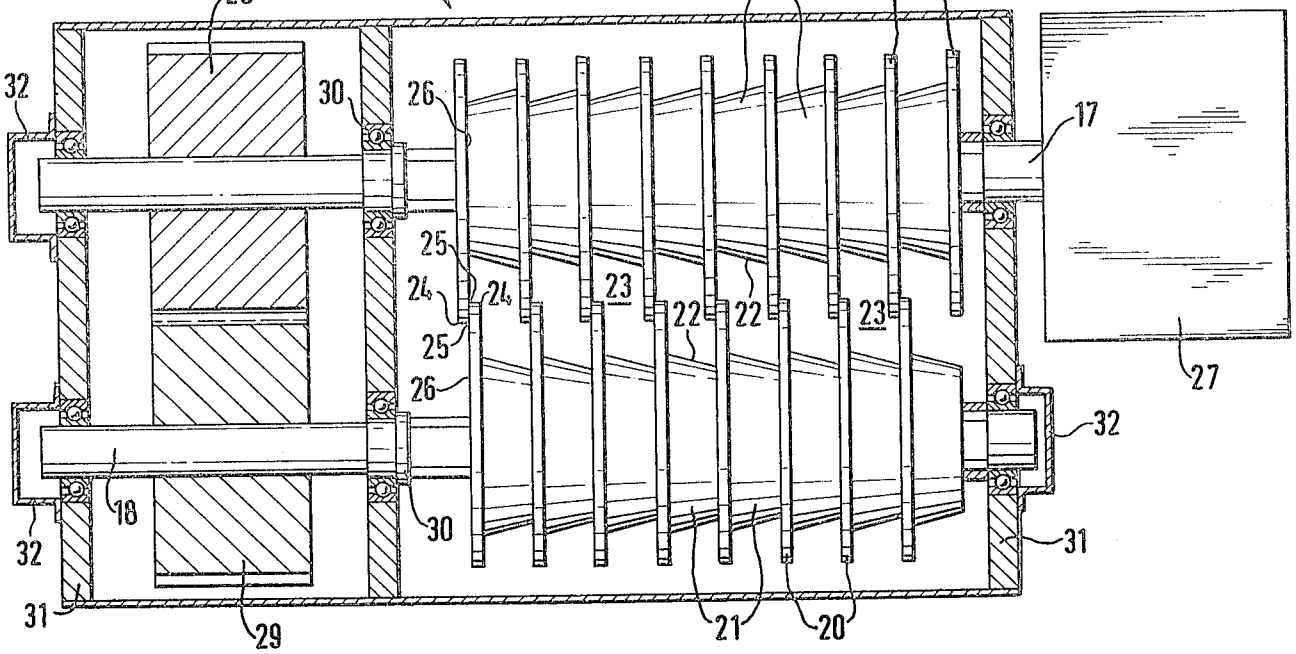
FIG. 2 shows a plan view, presented mainly in section, of a comminuting machine.
Figure 2A:
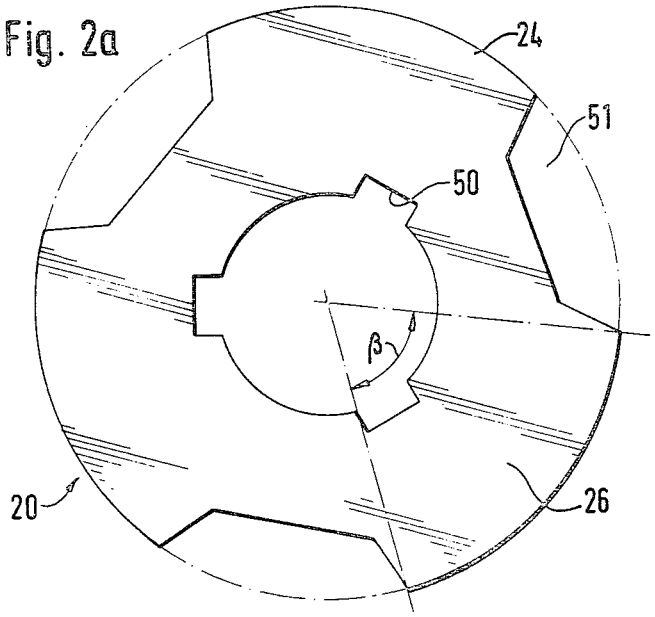
Figure 2B:
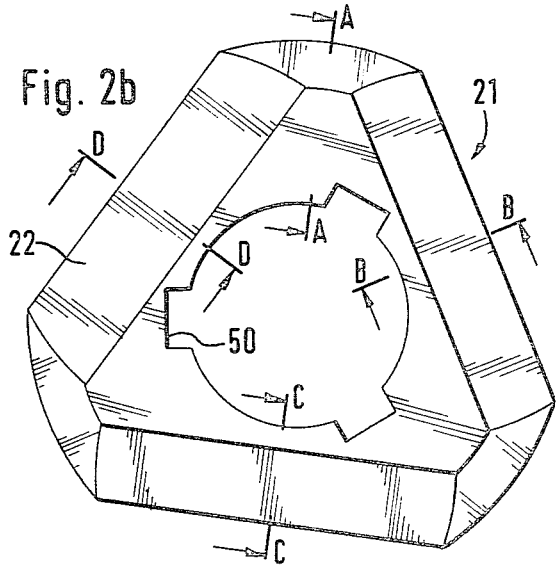

FIG. 2*a* shows the face view of a cutting disk usable in the comminuting machine according to FIG. 2;

FIG. 2*b* shows the face view of a spacer usable in the comminuting machine according to FIG. 2, as seen from the tapered end, which in its contour facing the cutting disk is adapted to the contour of the cutting disk of FIG. 2*a;*

Figure 3:
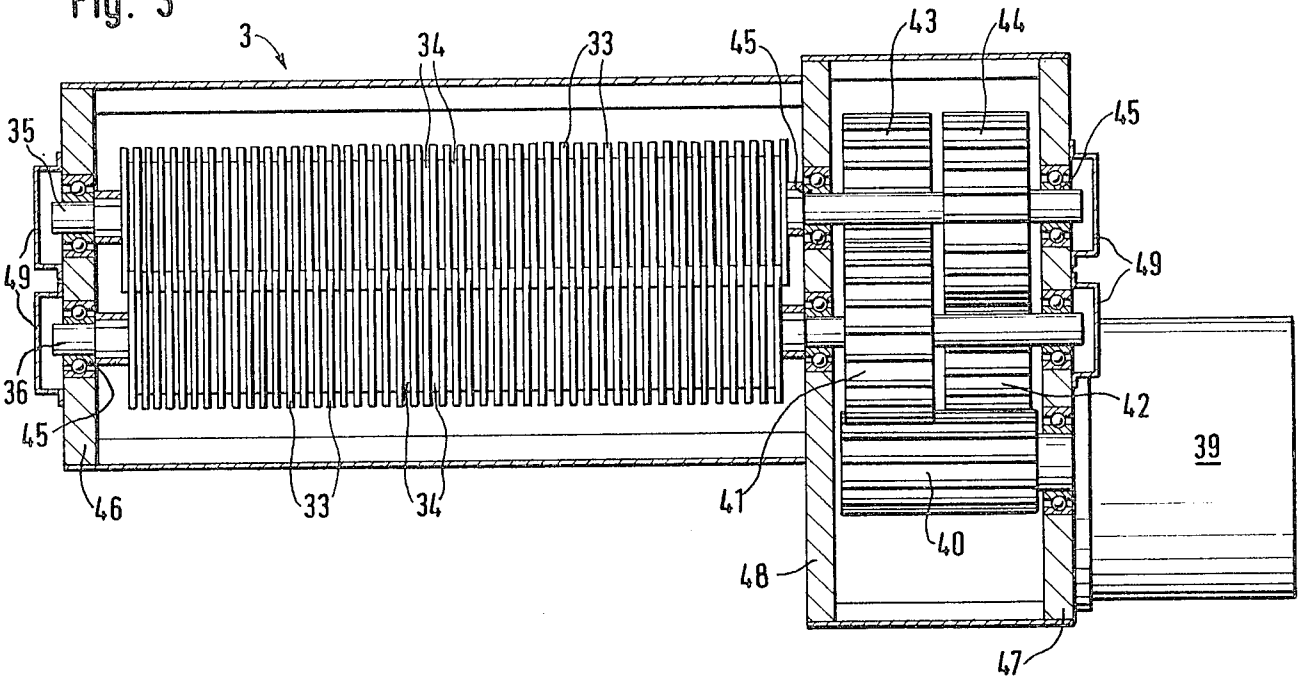

FIGS. 2*ba* to 2*bd* show various partial cross sections for FIG. 2*b,* as indicated;

FIG. 3 shows a view, likewise drawn mainly in section, of a granulating machine for the comminuting plant according to the invention; and FIG. 3*a* shows the face view of a disk usable in the granulating machine according to FIG. 3.

Figure 1:
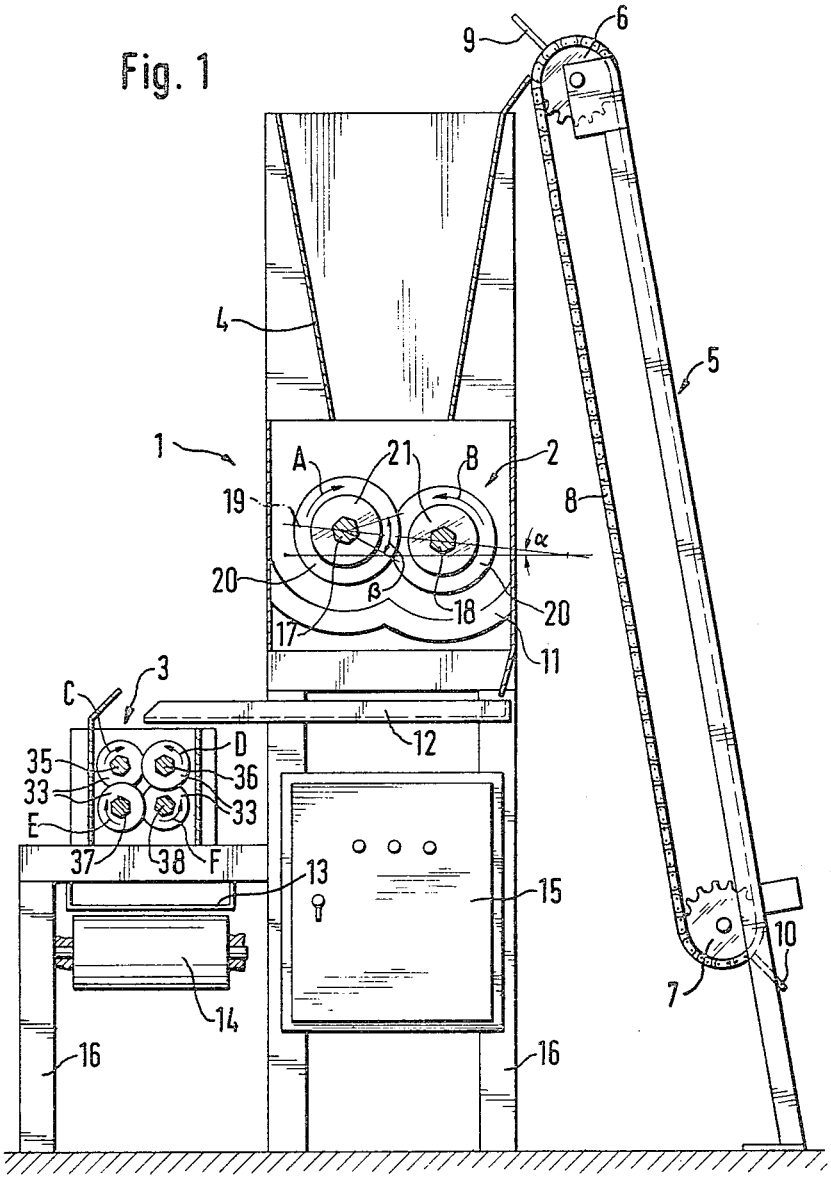
FIG. 1 shows schematically, partly in section a side view of a comminuting plant according to the invention equipped with comminuting machine and granulating machine, especially for the comminution of vehicle tires.

The comminuting plant 1 according to FIG. 1 presents a comminuting machine 2 and a granulating machine 3 engaged on its outlet side. The comminuting machine 2 serves especially for the coarse comminution of bulky material, while the granulating machine takes over the fine granulation of the precomminuted material from the comminuting machine. Above the comminuting machine 2 there is a filling hopper 4, into which the material to be comminuted is conveyed by means of a conveyor 5. The conveyor 5 in the example of execution represented of a comminuting plant 1 is constructed as a tire lift for vehicle tires. The tire lift has two chain sprocket wheels 6, 7 arranged in vertical spacing from one another, over which there runs a chain 8, on which in suitable spacing there are arranged projections 9, 10, by which the suspended vehicle tires are individually entrained to the height of the upper edge of the hopper 4. From the hopper 4 the vehicle tires pass into the comminuting machine 2, in which they are precomminuted to such an extent that the comminuted material can fall through a screen 11 which is situated under the comminuting machine 2. The screen 11 can be relatively coarse-meshed, since in the comminuting machine 2 in this case there takes place only a precomminution. Underneath the screen 11 there is arranged a vibrator 12, which conveys the precomminuted material uniformly by vibrating into the granulating machine 3, which is located to the side underneath the comminuting machine 2. The granulated material delivered from the granulating machine 3 falls automatically onto a second vibrator 13 situated under it, which distributes this material finely and conveys it uniformly onto a magnetic roller 14 located under it, which separates out the steel particles present in the comminuted material, which in the present case from the steel belt of the vehicle tire, so that the material can be further processed free of metal. The individual parts of the comminuting plant 1, in particular the hopper 4, the comminuting machine 2, the screen 11, the vibrator 12, the granulating machine 3, the vibrator 13 and the magnetic roller 14, as well as an electric distributor box 15, are mounted upon or on a common machine frame 16. In the electric distributor box 15 there are located all the required electric switches and control installations, which are coupled with one another in such a way that there takes place an attuning of the functioning of the comminuting machine 2 to that of the granulating machine 3. In particular, an overload of the granulating machine 3, the comminuting machine 2 is switched off and the overloaded machine is reversed at a certain turning rate until cleared.

The comminuting machine 2 presents according to FIG. 2 shafts 17 and 18 parallel to one another. The axes lie on a common plane 19 which is inclined by an angle $\alpha$ to the horizontal, as is evident from FIG. 1, in order to improve the intake of the material to be comminuted. On the shafts 17 and 18 there are alternately fitted cutting disks 20 and spacers 21, changeably but so as to turn with the shafts. The shafts 17 and 18 in the case represented are constructed as hexagonal shafts. There can also be shafts, however, with axially running grooves, which are allocated to corresponding inside grooves 50 of the cutting disks 20 and of the spacers 21, into which in each case there engage axially running adjusting springs to establish the connection between shaft 17, 18 and cutting disks 20 and spacers 21, respectively. The respective arrangement of cutting disks 20 and spacers 21 on the two shafts 17 and 18 is made in such a way that the cutting disks 20 of adjacent shafts cooperate, touch in rotation in pairs, at least intermittently, in the zone of the facing cutting edges 24 and 25, respectively.

As represented in FIG. 2*a*, the cutting disks 20 have, for example, on their periphery arcuate cutting edges 24 and 25, between them there remain intake zones 51 substantially free of cutting edges. In this manner the cutting disks 20 allocated to one another touch only intermittently, namely when and insofar as the arcuate cutting edge section 25 of a cutting disk 20 of the shaft 17 comes more or less in register with a corresponding cutting edge section 25 of the associated cutting disk 20 of the adjacent shaft 18. The arcuate cutting edges may have differing peripheral length. The central angle $\beta$ corresponding to the peripheral length of the arcuate cutting edges may vary, for example between 20° and 80°. The construction (not shown in FIG. 1) of intake zones 51 between the arcuate cutting edges 24, 25 serves mainly for the intake of the material to be comminuted into the comminuting machine 2, but also prevents a winding of material. The cutting disk 20 represented has a central recess with grooves 50, which fit onto corresponding adjusting springs for connection with the shafts 17, 18.

The cutting disks 20 may be angularly offset to one another on one and the same shaft 17 or 18. The shafts 17 and 18 are preferably driven asynchronously to one another. The spacers 21 have a smaller diameter and a greater axial thickness than the cutting disks 20, so that the peripheral surfaces 22 of spacers 21 lying opposite one another are arranged in axial spacing from one another and bound interspaces 23 for the passage of the comminuted material.

FIGS. 2*b* and 2*ba* to 2*bb* illustrate how the spacers 21 in their outer periphery, especially on the side lying adjacent to the associated cutting disk 20, are adapted to the outer contour of the cutting disk 20. Thus, for example, the spacer 2*b* is fitted to the outer contour of the cutting disk 20 according to FIG. 2*a*, so that this cutting disk is supported over a large surface of the side surface 26 opposite the cutting edge 25 that is operative at the moment and the cutting disk 20 projects radially only slightly beyond the associated spacer 21 in the zone of the cutting edges 24, 25. The spacers 21 taper toward their respective opposite end and are arranged on the respective axes 17 and 18 in such a way that the tapered part points in the opposite axial direction, so that the interspaces 23 are as large as possible. The nonround peripheral surface 22 of the spacers 21 prevents a winding of material and keeps the interspaces 23 clear. The interacting cutting edges 24 and 25 cut the material to be comminuted to a desired piece size, to which the mesh width or pass width of the screen 11 is adapted. If need be, the material is repeatedly cut up until it can pass through the screen 11. According to FIG. 2, the cutting disks cooperate there with the cutting edges 25 provided on the facing side surfaces 26. If these cutting edges should be worn down and a coming together of the disk-and-spacer sets no longer ensures a faultless comminution, the disks 20 can be turned around, so that they then enter into operative contact with the facing cutting edges 24 not yet worn down.

The shaft 17 in the case represented is driven directly by a geared motor 27, which engages on its one end. Instead of this direct mechanical drive, however, there may also be provided a direct hydraulic or an indirect drive over a belt transmission, the latter, for example in the case that on blocking of the cutting mechanism by pieces of metal or the like the torque is to be compensated. Here there can be provided additionally on the gear a torque stay known per se, which catches up a part of the torque by swinging the gear plane in the event of blocking. On the end of the shaft 17 lying opposite the geared motor 27 there is fastened to turn with the shaft a gear wheel 28 that meshes with a gear wheel 29 keyed on the corresponding end of the shaft 18. In consequence, the shaft 18 is driven in opposite direction to the shaft 17, and namely in such a way that the material to be comminuted is drawn into the interspaces 23, as is indicated, furthermore, by the arrows A and B in FIG. 1. The drive of the shafts 17 and 18 may, however, also take place asynchronously, in order, especially in the case of arcuately formed cutting edges 24, 25, to assure a uniform wearing down of the cutting disks 20, and to achieve, besides the cutting, also a tearing of the material. The shafts 17 and 18 are also separately drivable.

To readjust the cutting disks 20 there are provided bearing adjustment bushes 30. The fixed side plates 31 are simultaneously bearing plates in which the shafts 17 and 18 are borne on both sides. On the side plates 31 there are arranged bearing covers 32 to prevent foreign bodies from penetrating into the bearings of the shafts 17 and 18 from outside.

The granulating machine 3 according to FIG. 3 serves in the combination comminuting plant 1 for the after-comminution or fine comminution of the precomminuted material coming from the comminuting machine 2. The granulating machine 3 presents for this purpose four shafts 35, 36, 37 and 38, which in the embodiment represented are constructed as hexagonal shafts and on which there are alternately fitted granulating disks 33 and spacer disks 34, which are slightly thicker than the granulating disks 33, to turn with the shafts. The axes of these shafts lie, as is evident from FIG. 1, in the corner points of a square, so that not only the granulating disks 33 of the parallel shafts 35 and 36 lying in the upper horizontal plane and the shafts 37 and 38 lying in the lower horizontal plane engage in one another on their periphery. Furthermore, also the granulating disks 33 of the parallel shafts 35 and 37, and respectively 36 and 38, lying in each case vertically over one another correspondingly, engage in one another as is to be seen from FIG. 1. The shafts 35, 36 on the one hand and the shafts 37, 38 on the other hand are in each case driven in such a way that the material fed in from above is conducted downward between the shafts. The granulating disks 33 turn in opposite direction in all four zones of interengagement, as is clarified with the aid of the arrows C, D, E and F in FIG. 1. The material to be comminuted, by reason of the four-shaft shaft-set arrangement, is comminuted not only between the granulating disks 33 engaging in one another horizontally adjacently, but also between the granulating disks 33 interengaging in each case vertically over one another, whereby there can be achieved an extremely fine-grained granulate, which would not be attainable by the engagement in succession of two two-shaft arrangements of shafts. The granulating disks 33, shown in FIG. 3*a*, have on their outer periphery a toothing 52 of teeth 53, which have essentially radial side flanks 54 and are radially symmetrical. By reason of this layout the functioning of the granulating disks 33 is independent of their turning direction, i.e., the granulating disks 33 can be reversed on the shafts on wearing down of the respective leading edges, where by respective trailing edges, not yet worn down, come into operation. The granulating disks 33 allocated to one another in each case, as is evident from FIG. 3, engage more deeply in one another than corresponds to the toothing depth of the toothing 52. In this manner it can be assured that even in the case of a possible loosening of the disk sets the granulating disks 33 do not mesh. For the drive of the shafts 35 to 38 there is provided a geared motor 39, on the output shaft of which there is keyed a gear wheel 40 which meshes with a gear wheel 41 keyed on the shaft 36 and a gear wheel 42 keyed on the shaft 38. The gear wheel 41 meshes on its part with a gear wheel 43 fastened to the shaft 37 to turn with the shaft, while the gear wheel 43 meshes with a gear wheel 44 arranged on the shaft 35 to turn with the shaft. Here, too, there may again be provided an indirect drive. The shafts 35 to 38 are borne in bearing bushes 45, which are located in the side walls 46 and 47 and in the partition 48 of the granulating machine 3. Here, too, furthermore, there are arranged bearing covers 49. The bearing bushes 45 are adjustably designed, so that it is possible to readjust the shafts 35 to 38.

The cutting disks 20 and the granulating disks 33, as well as the spacers 21 and the spacing disks 34, may consist preferably of hard or hardened steel.

I claim:

1. A comminuting machine for comminuting material comprising:

(a) a first parallel rotary shaft and a second parallel rotary shaft;

(b) means for rotating said parallel rotary shafts in opposite directions;

(c) a plurality of cutting disks disposed on said first and second parallel shafts, said cutting disks each being provided on both peripheral edges thereof with a plurality of spaced apart, arcuate cutting edges, said arcuate cutting edges having a circumferential length corresponding to a central angle of between 20° and 80°; and (d) a plurality of cutting disk spacers removably disposed alternately with said cutting disks on said parallel shafts so that said spacers rotate with said shafts, said cutting disk spacers having a diameter smaller than a diameter of the cutting disks, said cutting disks on said parallel shafts being allocated to each other in pairs only, and upon rotation, touch each other on a corresponding, peripheral, arcuate cutting edge surface when in register and adjacent to each other, said cutting disk spacers having portions defining a space therebetween for the passage of comminuted material, said cutting disk spacers being provided on an end face portion with a cross-sectional configuration which is relatively the same as a cross-sectional configuration of an abutting associated cutting disk, said cutting disk spacers being conical in their axial length, and complimentary conical cutting disk spacers on said parallel shafts each tapering in an opposite axial direction.

2. A comminuting plant according to claim 1, wherein on at least one cutting disk there are provided arcuate cutting edges with differing lengths.

3. A comminuting plant according to claim 2, wherein the cutting disk spacer end face abutting the associated cutting disk is polygonal in cross-section, according to the number of arcuate cutting edges of said abutting cutting disk.

4. A comminuting plant according to claim 3, wherein said parallel shafts are driven asynchronously.

5. A comminuting plant according to claim 4, wherein each of the two parallel shafts has an axis, the axes of the two parallel shafts defining a plane, said plane inclined by an angle of preferably not more than 30° to a plane which is relatively perpendicular to a direction of flow of the material being fed into the comminutor.

6. A comminuting plant comprising:

(a) a granulating machine having at least two parallel first shafts arranged in a first plane; and (b) at least two parallel second shafts arranged in a second plane, said first and second planes being disposed parallel to each other, and axes of said first and second shafts defining corners of a square;

(c) a plurality of granulating disks disposed on said first and second shafts, said disks having a plurality of teeth portions disposed on a peripheral edge thereof, said teeth portions having a selected toothing depth; and (d) spacer disks alternately disposed on said parallel shafts between said granulating disks whereby a granulating disk on one shaft in one of the said planes engages between a pair of granulating disks on at least another shaft lying in said first plane and between a pair of granulating disks on at least another shaft lying in said second plane at least to a depth that is greater than the toothing depth of said teeth portions of the engaging granulating disk.

7. A comminuting plant according to claim 6, wherein the spacer disks have a slightly greater axial length than the granulating disks.

8. A comminuting plant according to claim 7, wherein the teeth portions have substantially radial flanks.

9. A comminuting plant according to claim 8, wherein individual teeth portions are radially symmetrical.

* * * * *